US006914541B1

(12) United States Patent
Zierden

(10) Patent No.: US 6,914,541 B1
(45) Date of Patent: Jul. 5, 2005

(54) SYSTEM AND METHOD FOR DETECTING AND IDENTIFYING TRAFFIC LAW VIOLATORS AND ISSUING CITATIONS

(76) Inventor: William E. Zierden, 123 Spa View Ave., Annapolis, MD (US) 21401

( * ) Notice: Subject to any disclaimer, the term of this patent is extended or adjusted under 35 U.S.C. 154(b) by 0 days.

(21) Appl. No.: 10/733,338

(22) Filed: Dec. 12, 2003

Related U.S. Application Data

(63) Continuation of application No. 09/901,005, filed on Jul. 10, 2001, now Pat. No. 6,690,294.

(51) Int. Cl.[7] ..... G08G 1/017

(52) U.S. Cl. ..... 340/937; 340/933; 340/936; 348/148

(58) Field of Search ..... 340/937, 933, 340/936, 905, 928; 348/148, 149; 701/215, 301, 119

(56) References Cited

U.S. PATENT DOCUMENTS

| | | | | | |
|---|---|---|---|---|---|
| 4,774,571 | A | | 9/1988 | Mehdipour et al. | 358/108 |
| 4,847,772 | A | | 7/1989 | Michalopoulos et al. | 364/436 |
| 5,179,441 | A | | 1/1993 | Anderson et al. | 358/88 |
| 5,351,044 | A | | 9/1994 | Mathur et al. | 340/901 |
| 5,381,155 | A | | 1/1995 | Gerber | 342/104 |
| 5,408,330 | A | * | 4/1995 | Squicciarini et al. | 386/107 |
| 5,451,758 | A | * | 9/1995 | Jesadanont | 235/384 |
| 5,515,042 | A | * | 5/1996 | Nelson | 340/937 |
| 5,515,285 | A | | 5/1996 | Garrett, Sr. et al. | 364/460 |
| 5,675,377 | A | | 10/1997 | Gibas | 348/47 |
| 5,734,337 | A | | 3/1998 | Kupersmit | 340/937 |
| 5,805,209 | A | | 9/1998 | Yuge et al. | 348/149 |
| 5,938,717 | A | | 8/1999 | Dunne et al. | 701/117 |
| 5,948,038 | A | * | 9/1999 | Daly et al. | 701/117 |
| 6,083,353 | A | | 7/2000 | Alexander, Jr. | 202/158 |
| 6,118,475 | A | | 9/2000 | Iijima et al. | 348/42 |
| 6,121,898 | A | | 9/2000 | Moetteli | 340/933 |
| 6,125,198 | A | | 9/2000 | Onda | 382/154 |
| 6,160,494 | A | | 12/2000 | Sodi et al. | 340/936 |
| 6,161,066 | A | | 12/2000 | Wright et al. | 701/36 |
| 6,188,329 | B1 | | 2/2001 | Glier et al. | 340/932.2 |
| 6,351,208 | B1 | | 2/2002 | Kaszcak | 340/425.5 |

* cited by examiner

*Primary Examiner*—Phung Nguyen
(74) *Attorney, Agent, or Firm*—Blank Rome LLP

(57) ABSTRACT

The present invention is directed to a mobile or stationary traffic monitoring system for detecting violations of speed limits or other traffic laws by vehicle operators and issuing citations to an operator and/or vehicle owner suspected of a violation using a digital camera to capture images of the operator and/or the vehicle, transmitting the captured images and other relevant data to an analysis center where the images and data are analyzed to determine whether to issue a citation and, if so, to issue the citation or take other appropriate law enforcement measures. The invention is also directed to a method for capturing images of a vehicle and/or vehicle operator suspected of a traffic violation, determining the time and geographic location of the suspected violation, transmitting the images and other data to an analysis center, issuing citations to violators and deriving revenue therefrom.

20 Claims, 4 Drawing Sheets

SPEED DETERMINATION USING ACTUAL LICENSE PLATE SIZE

SPEED DETERMINATION USING RELATIVE CHANGE IN LICENSE PLATE SIZE

SYSTEM AND METHOD FOR DETECTING AND IDENTIFYING TRAFFIC LAW VIOLATORS AND ISSUING CITATIONS

This Application is a continuation of U.S. patent application Ser. No. 09/901,005 filed on Jul. 10, 2001. Now U.S. Pat. No. 6,690,294.

BACKGROUND OF THE INVENTION

1. Field of the Invention

The present invention is directed to a mobile or stationary traffic monitoring system for detecting violations of speed limits or other traffic laws by vehicle operators and issuing citations to an operator and/or vehicle owner suspected of a violation using a digital camera to capture images of the operator and/or the vehicle, transmitting the captured images and other relevant data to an analysis center where the images and data are analyzed to determine whether to issue a citation and, if so, to issue the citation or take other appropriate law enforcement measures. The invention is also directed to a method for capturing images of a vehicle and/or vehicle operator suspected of a traffic violation, determining the time and geographic location of the suspected violation, transmitting the images and other data to an analysis center, issuing citations to violators and deriving revenue therefrom.

2. Description of the Prior Art

Traffic violations, particularly speeding, are a major cause of accidents on roads and highways. A common method to catch speeders is to set up a stationary radar or laser site along a roadway to identify speeders and issue citations. According to this method, a police officer uses a radar or laser gun to determine the speed of an approaching vehicle. If the officer determines that the approaching vehicle is speeding, he directs the driver to pull over to the side of the road and issues a citation. A similar method is for a police officer to place the radar/laser gun in his police vehicle, use it to detect whether vehicles are speeding and then pursue and pull over any vehicle he observes speeding. Both methods require the police officer to stop the vehicle primarily to identify the operator for purposes of issuing a citation.

More recently, traffic control systems using cameras have been placed at traffic-lighted intersections to capture vehicle and license plate images of a vehicle running a red light and issue a citation by mail without having to stop the vehicle. However, the use of such traffic control systems requires legislation that specifically sanctions the practice of issuing a citation to a vehicle owner based on license plate information without identifying the vehicle operator.

Apart from the need to pull a vehicle over to issue a citation to the driver, the use of a radar/laser gun by a police officer, whether stationary or mobile, has many other drawbacks. For instance, when a vehicle is stopped along the side of a road by a police officer to issue a citation to the driver for a traffic violation, both the officer and the occupants of the stopped vehicle are at risk of being hit by other passing vehicles. When a police officer pursues a speeding vehicle in what has become known as a "high speed chase," the officer's vehicle and the fleeing vehicle pose a serious danger to other travelers on the road. The police officer is also at risk when confronting an unknown and potentially dangerous driver and attempting to issue a citation to that driver. Moreover, large numbers of drivers have purchased detectors to alert them of the use of a radar/laser guns, and when alerted, a driver may quickly decelerate creating a danger of collision for vehicles traveling behind the decelerating vehicle. The use of CB radios to warn other drivers of a "speed trap" may have a similar result. The widespread use of such devices also diminishes the overall effectiveness of police use of radar/laser guns to detect speeding violations.

Additionally, the use of radar/laser guns place an added burden on the strained resources of a police department because officers must appear in court if a driver elects to contest or otherwise question the validity of a traffic citation. The primary reason for the officer's presence in court is to confirm the identity of the driver and to testify about the circumstances of the issuance of the citation.

The use of a high resolution digital imaging system to capture images and provide documentation of a variety of traffic violations provides a far safer and more productive alternative to the foregoing systems and methods currently in use. Such an imaging system is capable of taking digital images of a vehicle and the operator with sufficient resolution for identification purposes so that citations may be issued without having to pursue and stop the vehicle of a suspected violator. The images also serve as compelling evidence that may result in fewer court challenges and should relieve a police officer from court appearances merely to identify the vehicle operator.

Digital imaging and photographic technologies and imaging analysis technologies that are capable of capturing high resolution vehicle images from long distances for traffic monitoring and enforcement systems are known in the prior art. An example of such a system is disclosed in U.S. Pat. No. 5,515,042 to Nelson. The system of the Nelson patent comprises an apparatus that includes a camera for recording still or video images, an audio information recorder, a laser or radar speed detector, and a GPS receiver. The apparatus is mounted to the dashboard of a law enforcement vehicle and is operative to record photo images of the vehicle and vehicle license plate of a suspected speeder and imprint the vehicle speed, time and GPS-determined location onto the photo, all of which is stored for later evaluation. The operator of the apparatus in the law enforcement vehicle also records his or her observations on the audio recording device of the apparatus. At the end of a shift, the photos and audio recordings are recovered and reviewed to determine whether violations have occurred and citations should be issued.

U.S. Pat. No. 5,938,717 to Dunne et al. discloses a traffic control system that automatically captures an image of a vehicle and speed information associated with the vehicle and stores the image and information on a hard disk drive. The system uses a laser gun to determine whether a vehicle is speeding. The hard drive is later connected to a base station computer which is, in turn, connected to a LAN at which the information from the hard drive is compared with databases containing data such as vehicle registration information and the like. The system automatically prints a speeding citation and an envelope for mailing to the registered owner of the vehicle U.S. Pat. No. 5,734,337 to Kupersmit discloses a stationary traffic control method and system for determining the speed of a vehicle by generating two images of a moving vehicle and calculating the vehicle speed by determining the distance traveled by the vehicle and the time interval between the two images. The system is capable of automatically looking up vehicle ownership information and issuing citations to the owner of a vehicle determined to be speeding.

U.S. Pat. No. 5,948,038 to Daly et al. discloses a method for processing traffic violation citations. The method includes the steps of determining whether a vehicle is violating a traffic law, recording an image of the vehicle committing the violation, recording deployment data corresponding to the violation, matching the vehicle information with vehicle registration information to identify the owner, and providing a traffic violation citation with an image of the vehicle, and the identity of the registered owner of the vehicle.

It would be desirable to provide a traffic violation monitoring system and method operable by law enforcement personnel as well as private citizens that captures high resolution digital images of a vehicle operator as well as digital images of the vehicle and vehicle license plate so as to positively identify the operator and vehicle involved in a traffic violation, not limited to speeding. It would also be desirable to provide such a system and method that uses advanced communications and GPS location technology to provide comprehensive violation data for transmission to a remote evaluation center for data analysis and issuance of citations. Such a system and method should desirably collect all the evidence needed to support a traffic citation against a court challenge with minimal involvement of law enforcement personnel and provide a financial incentive to private citizens to become involved in traffic monitoring.

SUMMARY OF THE INVENTION

The present invention is directed towards a system for identifying and issuing citations to speeders or other traffic law violators (hereinafter referred to as the SPDCam system), and a method for permitting private citizens to use the SPDCam system to record evidence of suspected traffic violations for submission to law enforcement personnel.

The SPDCam system comprises a color digital imaging device (SPDCam device) connected to a global positioning satellite (GPS) system and a cellular telephone network. The imaging device is composed of two lenses or cameras, one facing a forward direction and the other facing a rearward direction so that images of both the front and rear of a vehicle may be recorded as the vehicle passes the imaging device. The image of the front of the vehicle records both the driver's face and a front license plate, and the rear image records the rear license plate. The two lenses can take either still or continuous images of the vehicle. Information obtained from the GPS system such as the imaging device's location, its speed and its direction of travel are attached to the images and sent by the cellular telephone to an analysis center where the images are reviewed. At the analysis center the images of the vehicle are analyzed to determine whether a traffic violation has occurred, and whether a citation or citations should be issued.

Also disclosed is a method for allowing private citizens to use the SPDCam system to capture images of vehicles violating traffic laws, submit the images to an analysis center and collect a percentage of the revenues generated from the fines.

With the foregoing and other objects, advantages and features of the invention that may become hereinafter apparent, the nature of the invention may be more clearly understood by reference to the following detailed description of the invention, the appended claims and to the several drawings forming a part hereof.

DETAILED DESCRIPTION OF THE INVENTION

Figure 1:
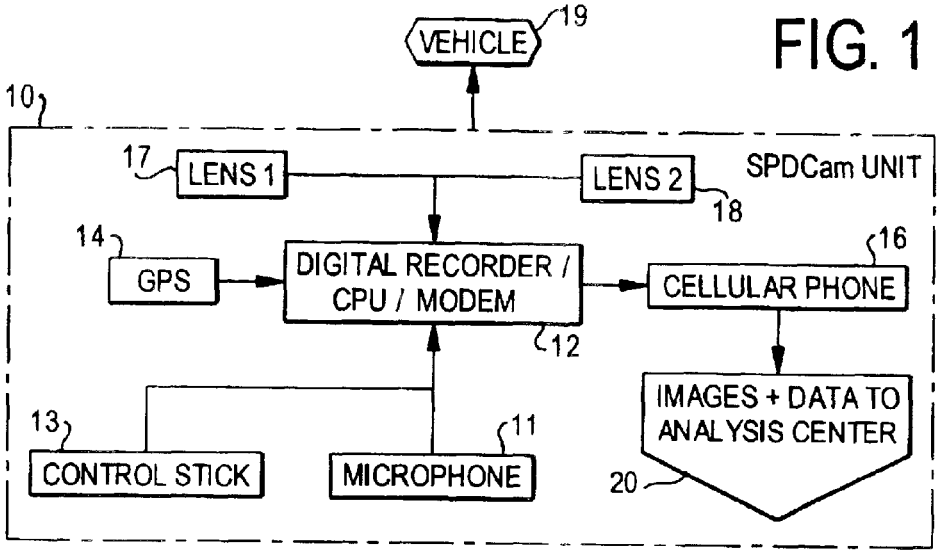
FIG. 1 is a block diagram of the SPDCam system of the present invention.

Referring now to the detail in the drawings, FIG. 1 is a block diagram of a digital imaging device (SPDCam device) 10 for capturing the image of a target vehicle 19 that is suspected of violating a traffic law. The SPDCam device 10 comprises two cameras, identified as lenses 17 and 18, for capturing the image of the target vehicle 19. A computer 12 comprising a digital recorder, a central processing unit (CPU), and a modem receives images from the lenses 17, 18 through a fiber optic or other cable. Geographic position information from a global positioning satellite (GPS) receiver 14 and recorded audio information from a microphone 11 are stored with the images from the lenses 17, 18 on the computer 12. The computer 12 processes, stores, and transmits the images and the geographic and audio data to an analysis center 20 via a cellular telephone 16. A control stick 13, which may be a keyboard or other conventional input device, is attached to the computer 12 and is used by the operator to control the various functions of the SPDCam device 10. The microphone 11 permits the operator to attach contemporaneous voice messages to the images recorded on the computer 12, for example, a description of the circumstances surrounding the recording of the images.

In the preferred embodiment of the invention, the SPDCam device 10 is mounted to a source vehicle, normally a motor vehicle, such as a police car or private automobile, which can be either mobile or stationary. The SPDCam device 10 can also be placed on a stationary or movable support alongside a road or can be constructed as a handheld device without altering its mode of operation. The two lenses 17 and 18 are pointed in opposite directions so that a rearward facing lens 18 records one or more images of a target vehicle 19 as it approaches the SPDCam device 10, thereby capturing images of the vehicle driver's face and front license plate. The other lens 17 is a forward facing lens that records one or more images of the vehicle as it moves away from the SPDCam 10, in particular, capturing an image of the rear license plate of the vehicle. The lenses are high resolution wide-angle lenses that are capable of recording images in at least one lane of traffic to either side of the lane in which the source vehicle is traveling.

The SPDCam device 10 can be configured as a video camera or a photographic camera, or both, and thus can record both continuous and still images of a target vehicle. In either mode of operation, the images of the target vehicle are preferably used to calculate the speed of the target vehicle as well as identify the target vehicle and its driver as described in more detail hereinafter.

The two modes of operation are similar except that the number of frames per second in the video mode of operation is higher, typically 24 frames/second or more, than in the photographic mode of operation. The video mode captures images at a rate of at least about 24 frames per second, which is approximately the minimum frame rate required to give the illusion of motion. The photographic rate is set lower, for example, a rate of about 2 to 5 frames per second to conserve memory in the device 10. The rate of 2–5 frames per second is for illustrative purposes only and is not meant to limit the scope of the invention. The frame rate may be adjusted depending on the amount of memory available and the number of images that are necessary to accurately calculate the speed of target vehicle. In other respects, the operation of the SPDCam device 10 is the same in both image-capturing modes.

In operation, the lenses 17 and 18 constantly record images, with the most recent time period, e.g., 120 seconds, of images being retained in the computer memory at any given time. As new images are acquired, older ones are erased. When a target vehicle is identified, the system operator activates an "Event" on the SPDCam device 10 to begin collecting data for the target vehicle. When the "Event" is initiated, the prior 120 seconds of images are permanently stored, and subsequent images of the target vehicle are continuously captured and stored in the computer memory until the operator "Ends" the event. GPS data and the entirety of the audio recording is retained from the start of the event to the end thereof, and stored with the images.

The control stick 13 may be a conventional manual input device with switches and/or keys (not shown) that control the various functions of the SPDCam device 10. For example, switches may be provided for selecting between the video mode and the photographic mode of operation or selecting between one or both of the lenses 17, 18 so that a single lens may be used when necessary or, as in the preferred embodiment, so that both lenses are used simultaneously. A "Power" key turns the device 10 on and initiates the recording of the 120 second loop of images. An "Event" key permanently stores the most recent 120 seconds of images while continuing to record until an "End/Store" key is pressed to stop the recording of the images. All the images are stored in the memory of the computer 12. A "Microphone" key activates the audio recorder attached to the microphone 11 and initiates the recording of contemporaneous voice recordings for transmission to the computer 12. An "Erase" key may be used to erase the images and other data stored in the computer memory. A "Submit" key activates the cellular telephone 16 connected to the computer 12 which transmits the images and other collected data to the analysis center 20. An "Emergency" key may be provided to activate the cellular telephone 16 and automatically dial "911" or other emergency number to contact an emergency response unit and transmit voice and/or GPS data to that unit. The cellular telephone 16 may also be programmed to dial other numbers set by the user of the SPDCam device.

The foregoing features facilitate the use of the SPDCam device 10 in a source vehicle, such as a police car, where one lens is mounted on the police car pointing in a rearward direction and the other lens is mounted pointing in a forward direction. When a target vehicle overtakes the police car from behind at a high speed, the system operator activates the SPDCam device which captures images of the overtaking vehicle from the rearward-facing lens for the last 120 seconds of the approach so that, inter alia, images of the driver's face are in the field of view and can be recorded. The forward facing lens then captures the image of the target vehicle, including the license plate and any other identifying indicia, as the vehicle passes the source vehicle. Both lenses 17 and 18 are recording simultaneously so that a continuous image of the vehicle is recorded as it passes from the rear to the front of the source vehicle.

The recorded images of the target vehicle are stored in the memory of the computer 12, and are each labeled with a unique serial number assigned to the SPDCam device 10, a unique frame number, a unique event designator, the date and time, and the location, speed and direction of the source vehicle obtained from the GPS system. Any related audio recording is preferably identified at the beginning of the recording by the operator's voice recording of the event designator and SPDCam device serial number, and preferably includes periodic time marks. The audio recording may be linked to the images and other vehicle data by other suitable means, e.g., a synthetic voice recording or the like.

The images are transmitted by cellular telephone 16 to the analysis center 20 at the end of each event or other appropriate time. The rate of transmission will be a function of the upload bandwidth capabilities of the existing cellular system, and will change as the cellular technologies develop, or will vary according to the cellular capabilities in a given geographic location. The cellular telephone 16 is programmed to automatically call the local analysis center 20 based upon its GPS coordinates, a national "800" number or other preprogrammed number. The cellular telephone may also be used by the SPDCam operator to call the analysis center to discuss any issues related to the images. The microphone 11 allows the SPDCam operator to use the cellular telephone in a "hands-free" mode. Similarly, the cellular telephone provides a means for the analysis center 20 to reach the operator of the SPDCam device 10. In addition to the cellular telephone 16, other transmission means may be used with the SPDCam device 10. For example, the images and data may be transmitted to the analysis center 20 by satellite, by connecting the computer 12 to a local telephone line, or by physically transporting the memory component of the computer 12 to the nearest analysis center 20.

In addition to being mounted in a vehicle, the SPDCam device 10 can also be set up adjacent the side of a road, with one lens facing one direction to capture frontal images of approaching vehicles and drivers, and the other lens facing the opposite direction to capture rear images of vehicles that have passed the device 10. The SPDCam device 10 can be mounted on a stationary support, such as a typical camera tripod, or can be miniaturized and configured as a handheld device.

Figure 2:
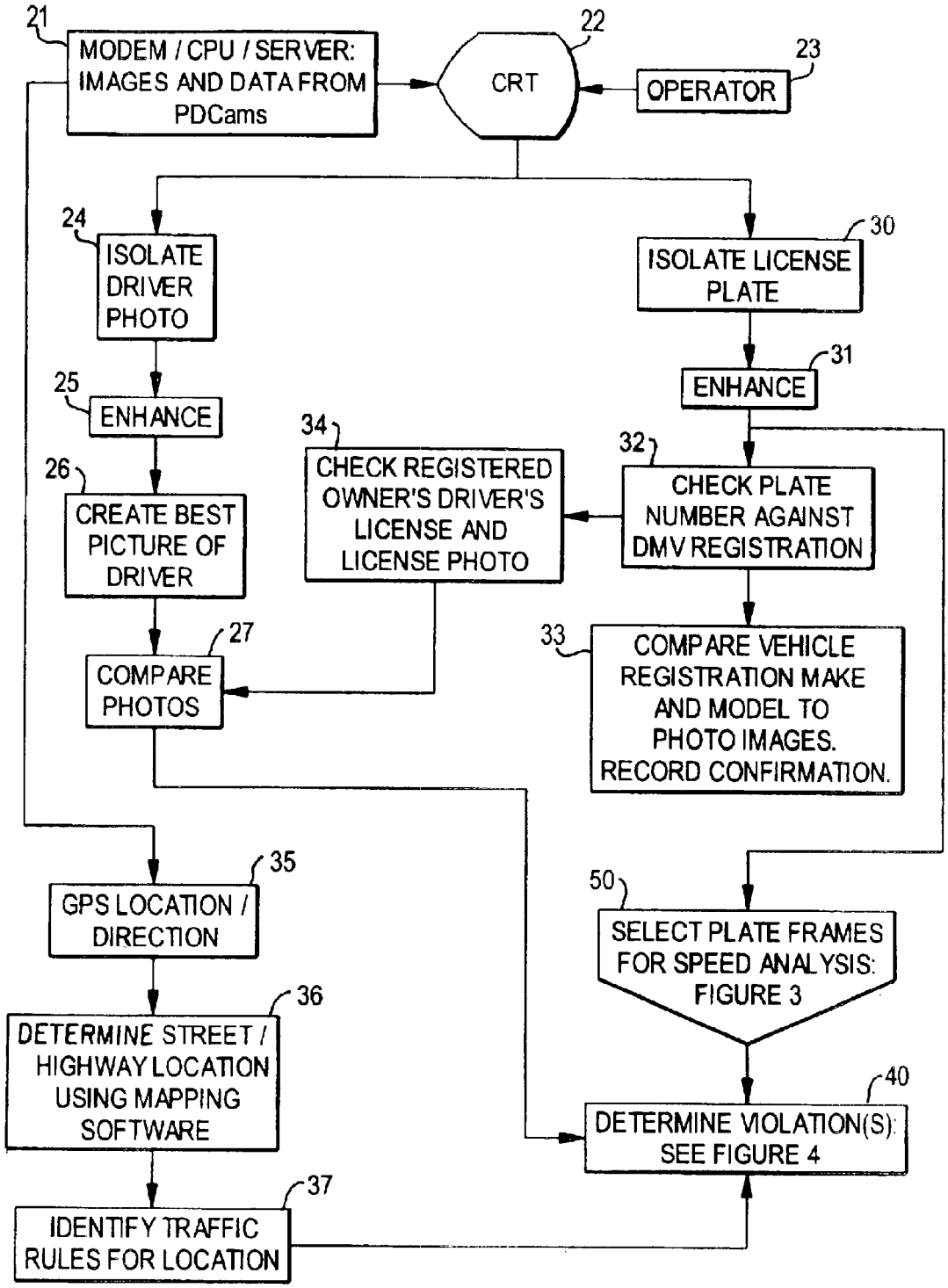
FIG. 2 is a flow chart showing the process of analyzing an image of a vehicle to determine whether a traffic violation has occurred.

FIG. 2 illustrates the process of analyzing the images after they are received from the SPDCam device 10. The images and other data are first received by a computer 21 at the analysis center 20. The analysis computer 21 displays the images on a monitor 22 to be reviewed by an operator 23, who is typically a police officer trained in the operation of the overall system and analysis of the data received from the SPDCam device. The images are preferably displayed in a split screen format so that the images from the two lenses 17, 18 can be viewed simultaneously. Since the lenses may have captured more than one vehicle, the operator 23 selects and isolates the target vehicle based on other available data and information, e.g., the audio recording, and proceeds with further analysis.

The operator modifies the original images of the target vehicle so that images of the driver and the target vehicle license plate are obtained as isolated images 24 and 30, respectively. These modified images are then enhanced using conventional digital image enhancement techniques in steps 25 and 31 to improve the quality of the images of the driver and license plate. Several images of the driver are modified and enhanced in this manner to obtain the best picture of the driver 26 for later comparison with records from the Department of Motor Vehicle (DMV) or other database containing driver photographic information.

The enhanced image of the license plate 31 is checked against DMV records in step 32 to identify the registered owner of the vehicle. A photograph of the registered owner is retrieved in step 34 by accessing DMV records and comparing registered owner records with driver's license records or other databases containing driver photographs. This photograph is then compared in step 27 with the best enhanced photo image obtained from the SPDCam device 10 in step 26 to determine whether the driver of the target vehicle is the registered owner of the target vehicle. As a backup measure, the make and model of the vehicle associated with the license plate number is compared to the make and model of the target vehicle in the image in step 33.

If the image of the driver of the target vehicle does not match the image of the registered owner of the target vehicle, the analysis process may include a further analysis step (not shown) of comparing the target vehicle driver image with photographs of licensed drivers having the same residence address as the registered owner of the target vehicle to determine whether, for example, a member of the family of the registered owner was the driver of the target vehicle. If that step does not produce an image match, then the analysis proceeds as described below in connection with FIG. 4.

Figure 3:
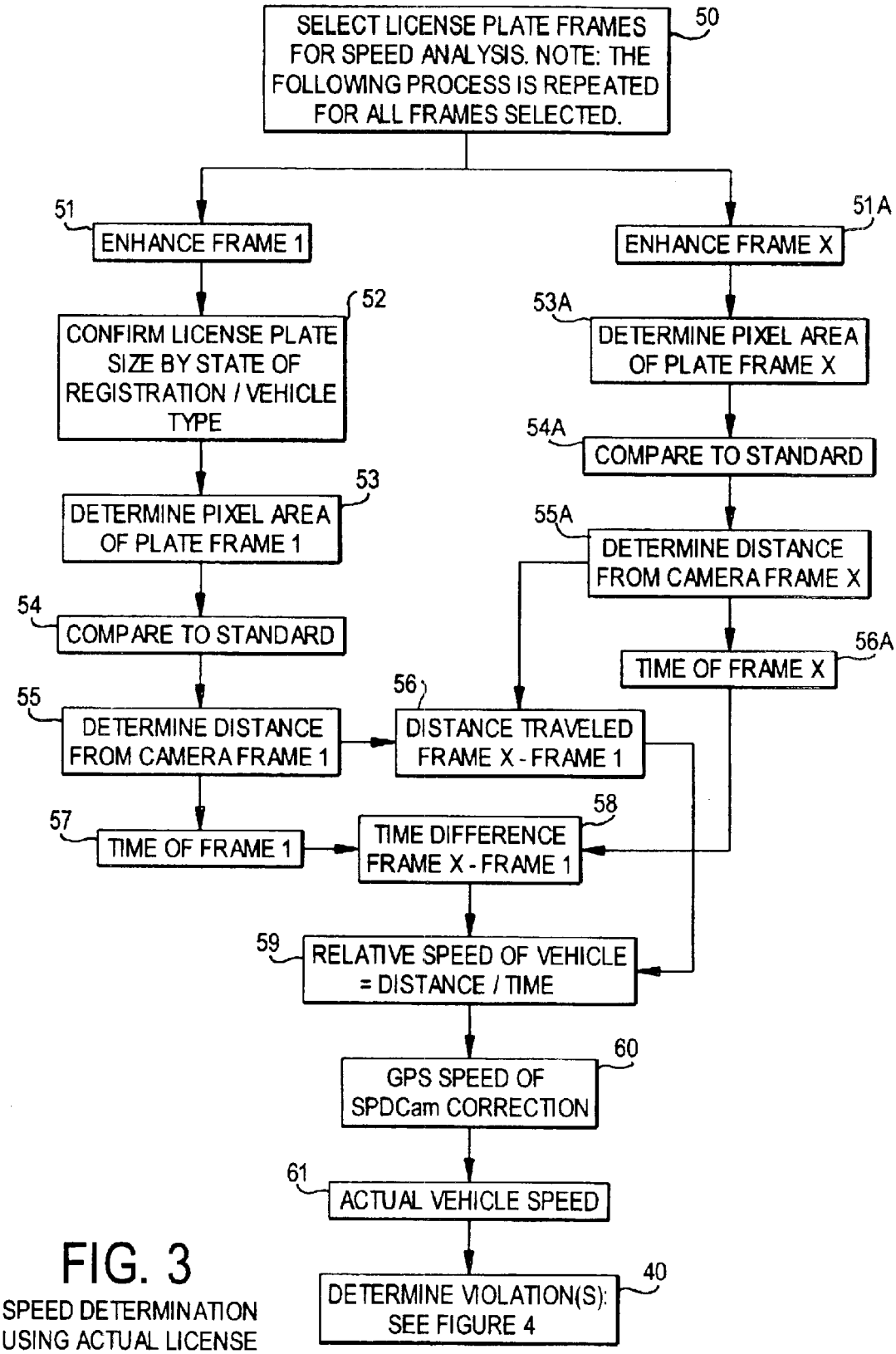
FIG. 3 is a flow chart showing a method of calculating the speed of a vehicle by comparing the size of a license plate in an image to a standard size license plate.
Figure 3A:
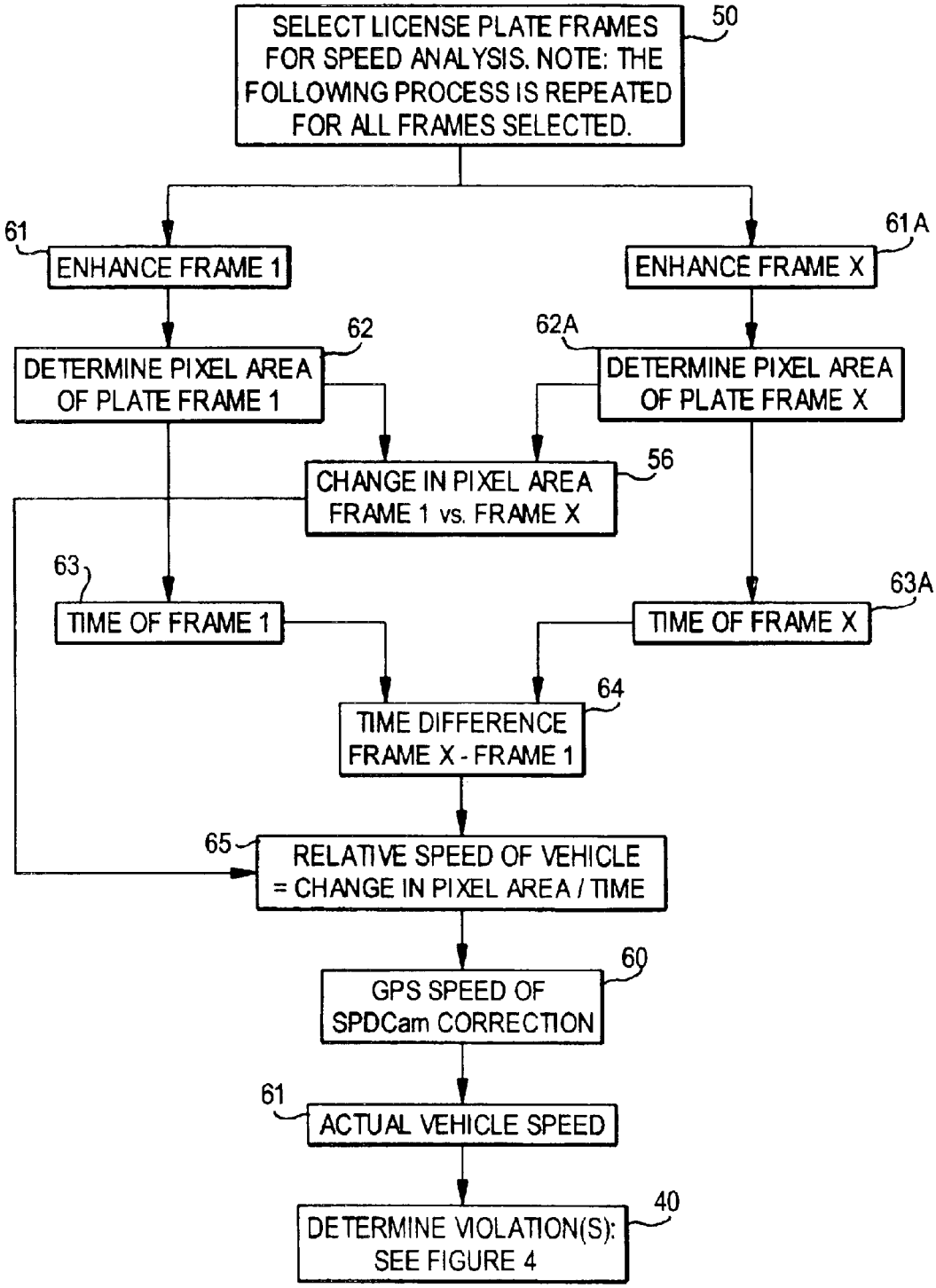
FIG. 3A is a flow chart showing a method of calculating the speed of a vehicle by comparing the size of a license plate in successive images of the vehicle.

The analysis center operator 23 also selects the speed analysis method in step 50 as will now be described. FIGS. 3 and 3A show alternative methods for determining the speed of a vehicle from the enhanced images of the license plate. According to one method, the speed of the target vehicle can be determined by comparing the size of the license plate in the image to a known standard size license plate, as shown in FIG. 3. According to the other method, the speed of the target vehicle is determined by comparing the relative change in the size of the license plate in successive images, as shown in FIG. 3A. One or both methods may be used for determining speed.

Referring first to the method depicted in FIG. 3, each SPDCam device 10 is manufactured and calibrated such that the size of a standard automobile license plate (12×6 inches) covers a fixed number of image pixels at a predetermined distance from the lenses 17, 18. After image enhancement in steps 51 and 51A of two time-separated frames, Frame 1 and Frame X, and confirmation of license plate size for the particular state that issued the license plate in step 52, the standard 12-inch by 6-inch license plate is used as a reference for further analysis. The pixel area of the license plate in Frame 1 is determined in step 53 and compared to the standard plate size in step 54. From that comparison, the distance from the license plate of the target vehicle to the SPDCam device lens 17 or 18 is calculated in step 55. The time of the Frame 1 is also recorded in step 57 for speed calculation purposes. The operator then selects and enhances a time subsequent Frame X in step 51A, determines the pixel area of the license plate in Frame X in step 53A, compares it to the known standard in step 54A, and calculates the distance between the target vehicle license plate and the lens 17 or 18 of the SPDCam device in step 55A. The time of Frame X is also recorded in step 56A. The relative speed of the target vehicle is then obtained in step 59 by dividing the distance traveled between Frame 1 and Frame X determined in step 56 by the time difference between Frame 1 and Frame X determined in step 58.

If the SPDCam device is stationary the relative speed determined in step 59 is the actual target vehicle speed. If the SPDCam device 10 is installed on a moving source vehicle, the relative speed of the target vehicle must be adjusted to determine the actual speed of the target vehicle by compensating for the speed of the source vehicle. The speed of the source vehicle is determined by averaging the GPS-determined speed of the source vehicle at Frame 1 and at Frame X, or by other speed determination means. The actual speed of the target vehicle 61 is then calculated in step 60 by either adding or subtracting the speed of the source vehicle to the target vehicle, depending on whether the target vehicle is overtaking or pulling away from the source vehicle. The actual target vehicle speed 61 is used to determine whether a violation has occurred in step 40 as described in more detail below in connection with FIG. 4.

A second method for calculating the speed of the target vehicle is shown in FIG. 3A. According to this method, an enhanced Frame 1 is selected in step 61 and its pixel area is determined in step 62 and the time of Frame 1 is recorded in step 63. A second Frame X is selected, its image enhanced in step 61A, its pixel area is determined in step 62A and its time is recorded in step 63A. The proportional change in pixel area of the license plate between Frame 1 and Frame X is related to the distance traveled by the target vehicle so that the distance traveled is calculated in step 56. The distance traveled from step 56 is divided by the time difference between Frame 1 and Frame X calculated in step 64 to yield the relative speed of the target vehicle in step 65. Stated another way, the calculation of the proportional reduction in the pixel size of the license plate per unit of time as the vehicle moves away from the SPDCam device (or enlargement of the plate as it moves toward the SPDCam device) yields the speed of the vehicle relative to the SPDCam device 10. In the same manner as in the FIG. 3 method, if the SPDCam device is mounted on a moving source vehicle, the relative speed of the target vehicle calculated in step 65 is corrected by the GPS-determined speed of the source vehicle in step 60 yielding the actual target vehicle speed 61. Also as in FIG. 3, the actual target vehicle speed 61 is used to determine whether a violation has occurred in step 40 as described in more detail below in connection with FIG. 4.

If the target vehicle is not directly in front of or behind the lenses 17 and 18 of the SPDCam device 10, for instance, if the target vehicle is in an adjacent lane to the source vehicle, the offset will affect the distance calculations and the speed determination. U.S. Pat. No. 5,734,337 to Kupersmit, the disclosure of which is incorporated by reference herein, discloses a method of compensating for the angular offset between the lens of a camera and a target vehicle. Other methods of correcting errors resulting from such an angular offset will be apparent to the skilled artisan.

Referring again to FIG. 2, the geographic location information and direction of movement of the source vehicle obtained from the GPS system in step 35 is used in conjunction with conventional mapping software to determine in step 36 the street or highway location where the images of the suspected traffic violation were recorded. The traffic laws for that location, particularly the speed limits, are then retrieved in step 37 and compared with the actual speed of the target vehicle to determine whether a violation has occurred in step 40, and what sanction, if any, is warranted.

Figure 4:
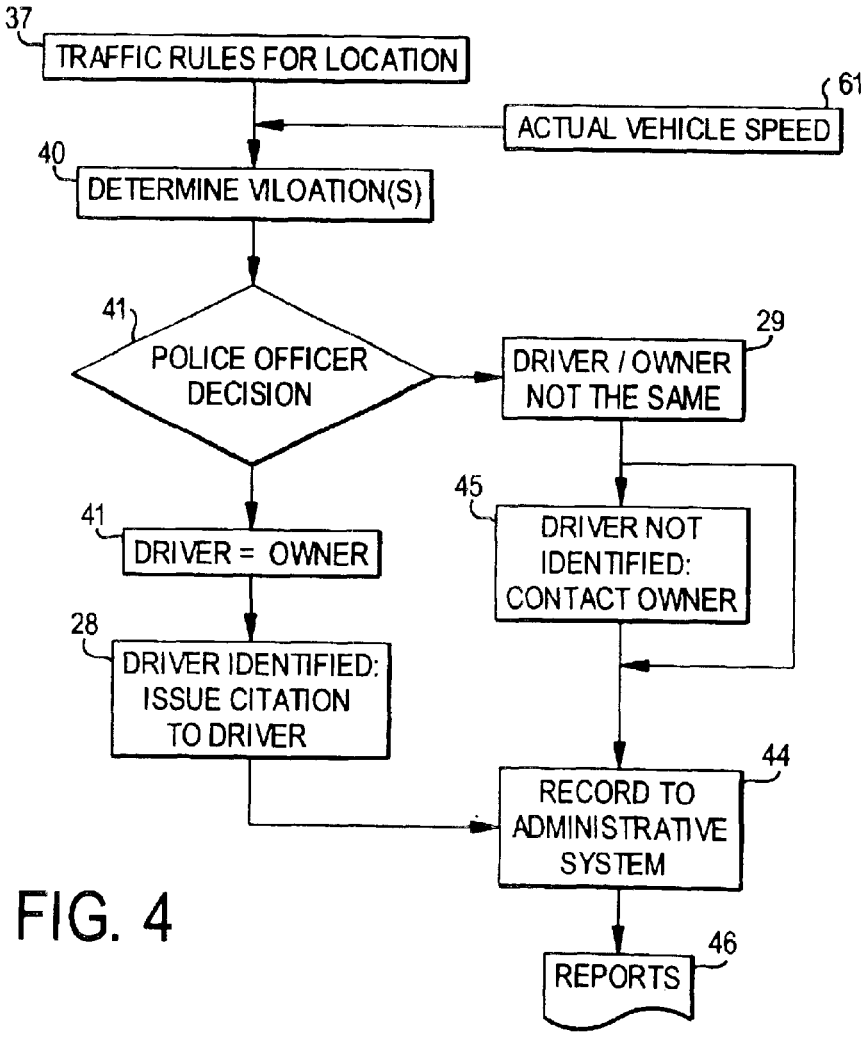
FIG. 4 is a flow chart of the method of the invention showing the steps taken after a determination is made that a traffic violation has occurred.

FIG. 4 illustrates the violation-determination process of the invention. The analysis operator 23 reviews all the available information to determine whether one or more traffic violations has occurred. For example, images of a vehicle may show that the driver of the vehicle ran a stop sign or was weaving in-and-out of traffic or otherwise driving dangerously. With respect to speed violations, comparison of the actual target vehicle speed 61 with the speed limit for the GPS-determined location of the target vehicle in step 37 may establish that a speeding violation has occurred. If the police officer/operator 23 determines that a violation has occurred in step 40, he then compares the photograph of the licensed driver and the driver of the speeding target vehicle in step 27 of FIG. 2 to determine if there is a match between the owner of the vehicle and the driver designated 28 in FIG. 4. If there is a match, the police officer/operator 23 makes a decision in step 41 to issue a citation to the driver/registered owner in step 42.

If the driver of the speeding target vehicle is unrecognizable from the image, or no match occurs in step 29, or if the driver has no association with the target vehicle or the registered owner, the registered owner may be contacted by police for further investigation in step 45. Whether or not the driver is identified, a machine-accessible electronic file and administrative record is created in step 44 of the circumstances of the violation for future use. The file created in step 44 is then used to generate reports in step 46 and to otherwise ensure proper supervision of the SPDCam system.

The use of the SPDCam system enhances the use of police manpower by leaving the analysis of the images to trained officials at the analysis center 20, permitting patrol officers to record and submit traffic violations without having to stop a driver and issue a citation. Furthermore, because the SPDCam system records images of both the vehicle and the driver, the images can be used as evidence in court for identification purposes. Alternatively, analysis center personnel may appear with the photographic evidence to support the charge of a violation.

It is also envisioned that the SPDCam device 10 will be used by both law enforcement officials as well as private citizens. Law enforcement officials would use the SPDCam system in much the same manner as other similar traffic enforcement systems currently in use, with the exception that a law enforcement officer would freed from the burden of having to stop vehicles suspected of violating a traffic laws and, in most cases, from having to appear in court.

The SPDCam device could be registered to and used by private citizens to capture images of vehicles and drivers violating traffic laws in a special SPDCam program. A private citizen would submit the images and other data to law enforcement officials using the SPDCam system of FIG. 1. Private citizens may be encouraged to purchase or lease the SPDCam device 10 by providing a financial incentive for any event they record that results in a conviction or payment of a fine. Criteria are established for any private citizen who wished to participate in the SPDCam program, including a rigorous application process involving criminal and driving background checks. Furthermore, in the event of a criminal conviction or other decertifying event, the private citizen may be denied further participation in the program.

Upon acceptance in the SPDCam program, a special credit account is established for each private citizen provided with the SPDCam system. A fee is charged for each submission of an event to the analysis center against the credit account to discourage private citizens from submitting frivolous events and unreliable data. Also, a limit is placed on the number of submissions an individual is allowed to submit on a monthly basis, for example, to encourage the submission of only the most egregious traffic violation events, and to discourage full-time vigilantism. The individual SPDCam operator then receives a percentage of any fees received by the jurisdiction from the issuance of a citation, which is credited to the individual's account. At the end of each month, the individual receives a monthly report of event submissions of his assigned system and the analysis center disposition of the event submissions.

Analysis centers 20 are established to receive the images sent from the SPDCams (operated by both law enforcement and private citizens). Depending on the laws of a particular state, the analysis centers 20 may be operated and managed by an independent contractor, along with sworn law enforcement personnel who conduct all image analysis and make all determinations as to appropriate police follow-up, including whether citations should be issued. The contractor receives a percentage of the citation fees received for operating the center.

Service Centers that sell, lease, install, inspect, test, certify and remove SPDCams are established in those jurisdictions that implement the SPDCam system. Service Centers are licensed by governmental jurisdictions and derive revenue from the sales and services provided.

Although certain preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method of enabling private individuals to assist law enforcement officials in the determination of traffic violations comprising the steps of:

supplying a private individual with an imaging device adapted to capture images of a target vehicle suspected of a traffic violation;

operating the imaging device to capture images of a target vehicle suspected of a traffic violation and transmitting the images of the target vehicle to an analysis center;

receiving the images of the target vehicle from the imaging device at the analysis center;

determining at the analysis center whether a traffic violation has occurred based on the images transmitted from the imaging device;

issuing a traffic citation if a traffic violation has occurred; and compensating the private individual if the traffic citation is issued.

2. The method of claim 1, further comprising the steps of providing the private individual with a unique identification code, and labeling the images with indicia that is associated with the unique identification code of the private individual.

3. The method of claim 1, further comprising the step of charging the private individual a fee for each submission of a suspected traffic violation to the analysis center.

4. The method of claim 1, including the step of limiting the number of submissions allowed by the private individual in a given time period.

5. The method of claim 1, wherein the step of compensating comprises paying the private individual a percentage of the fines associated with the traffic citation.

6. The method of claim 1, including the step of establishing a credit account for the private individual to administer the finances related to the operation of the imaging device.

7. The method of claim 1, wherein the supplying step comprises leasing the imaging device to the private individual.

8. A method of enabling private individuals to assist law enforcement officials in the issuance of traffic citations to operators of target vehicles suspected of traffic violations comprising the steps of:

establishing qualifications for a private individual to assist law enforcement officials in the issuance of traffic citations to operators of target vehicles suspected of traffic violations;

certifying a private individual under said qualifications to assist law enforcement officials in the issuance of traffic citations;

supplying a qualified private individual with a digital imaging device for capturing images of a target vehicle suspected of a traffic violation;

operating the digital imaging device to capture images of a target vehicle suspected of a traffic violation and submitting the images of the target vehicle to an analysis center;

receiving at the analysis center the images of the target vehicle from the digital imaging device operated by the private individual;

determining at the analysis center whether a traffic violation has occurred based on the images transmitted by the private individual;

issuing a traffic citation if a traffic violation has occurred;

collecting a fine from the issuance of the traffic citation; and paying a portion of the collected fine to the private individual.

9. The method of claim 8, further comprising the steps of providing the private individual with a unique identification code, and submitting the images with indicia that is associated with the unique identification code of the private individual.

10. The method of claim 8, further comprising the step of charging the private individual a fee for each submission of a suspected traffic violation to the analysis center.

11. The method of claim 8, including the step of limiting the number of submissions allowed by the private individual in a given time period.

12. The method of claim 8, wherein the supplying step comprises leasing the imaging device to the private individual.

13. The method of claim 8, further comprising the step of establishing rules which would decertify the private individual from continuing to operate an imaging device and decertifying an individual for violating an established rule.

14. A method of enabling private individuals to assist law enforcement officials in the determination of traffic violations comprising the steps of:

supplying a private individual with an imaging device for capturing images of a target vehicle suspected of a traffic violation and transmitting the images to an analysis center, said imaging device having an identification number associated with the private individual;

operating the imaging device to capture images of a target vehicle suspected of a traffic violation and transmitting the images of the target vehicle and the identification number to the analysis center;

receiving the images of the target vehicle from the imaging device and the identification number at the analysis center;

determining at the analysis center whether a traffic violation has occurred based on the images transmitted from the imaging device;

determining the identity of the private individual based on the identification number;

issuing a traffic citation if a traffic violation has occurred; and compensating the private individual if a traffic citation is issued.

15. A method of enabling private individuals to gather evidence of potential traffic violations to assist law enforcement officials in the determination of traffic violations comprising the steps of:

supplying a private individual with a device adapted to collect information regarding a target vehicle suspected of a traffic violation;

operating the information collecting device by the private individual to collect information regarding the target vehicle relevant to a traffic violation by the target vehicle and transmitting at least some of the information collected by the private individual to an analysis center;

receiving the transmitted information regarding the target vehicle at the analysis center;

determining at the analysis center whether a traffic violation has occurred based on the collected information;

issuing a traffic citation by law enforcement officials to an owner and/or operator of the target vehicle if a traffic violation has occurred; and compensating the private individual if the traffic citation is issued to the owner and/or operator of the target vehicle.

16. The method of claim 15, further comprising the steps of providing the private individual with a unique identification code, and labeling the images with indicia that is associated with the unique identification code of the private individual.

17. The method of claim 15, wherein the supplying step comprises supplying the private individual with an imaging device adapted to capture images of the target vehicle, the operating step comprises operating the imaging device to capture images of the target vehicle, the receiving step comprises receiving at the analysis center the images of the target vehicle from the imaging device and the determining step comprises determining at the analysis center whether a traffic violation has occurred based on the images received at the analysis center from the imaging device.

18. The method of claim 17, wherein the determining step further comprises using the received images to calculate the speed of the target vehicle.

19. The method of claim 17, wherein the operating step further includes the step of capturing images of the operator of the target vehicle.

20. The method of claim 15, including the step of installing the information collecting device in a motor vehicle operated by the private individual.

* * * * *